US005262577A

United States Patent [19]

Velcich

[11] Patent Number: 5,262,577

[45] Date of Patent: Nov. 16, 1993

[54] METHOD TO CONVERT REFUSE DERIVED FUEL INTO A COMBUSTIBLE GAS

[75] Inventor: Gianfranco Velcich, Udine, Italy

[73] Assignee: Daneco Danieli Ecologia SpA, Udine, Italy

[21] Appl. No.: 879,579

[22] Filed: May 7, 1992

[30] Foreign Application Priority Data

May 8, 1991 [IT] Italy ..... UD91A000074

[51] Int. Cl.[5] ..... C07C 1/00

[52] U.S. Cl. ..... 585/240; 201/17; 208/411; 48/197 R

[58] Field of Search ..... 208/411; 201/17; 48/197 R

[56] References Cited

U.S. PATENT DOCUMENTS 3,998,607 12/1976 Wesselhoft ..... 423/206 R
4,008,145 2/1977 Leas ..... 208/411
4,057,512 11/1977 Vadovic et al. ..... 201/17
4,078,989 3/1978 Leas ..... 208/414
4,147,615 4/1979 Leas ..... 208/414

*Primary Examiner*—Anthony McFarlane
*Attorney, Agent, or Firm*—Nixon & Vanderhye

[57] ABSTRACT

Method to convert refuse derived fuel (RDF) into a combustible gas, whereby the refuse derived fuel is gasified and the derived gas undergoes a process of catalytic cracking in which at least one alkaline additive or an equivalent product is used, the gas being passed through a cyclone separator to collect the particulate solids and thereafter undergoing a cooling process with recovery of hot air before being passed through sleeve filters, the ashes of the gasification and the particulate solids being sent to a dump for ashes, the ashes of gasification being riddled beforehand to gather the fines, which are mixed with fines coming from the sleeve filters and are employed as further catalysts in the catalytic cracking process.

10 Claims, 1 Drawing Sheet

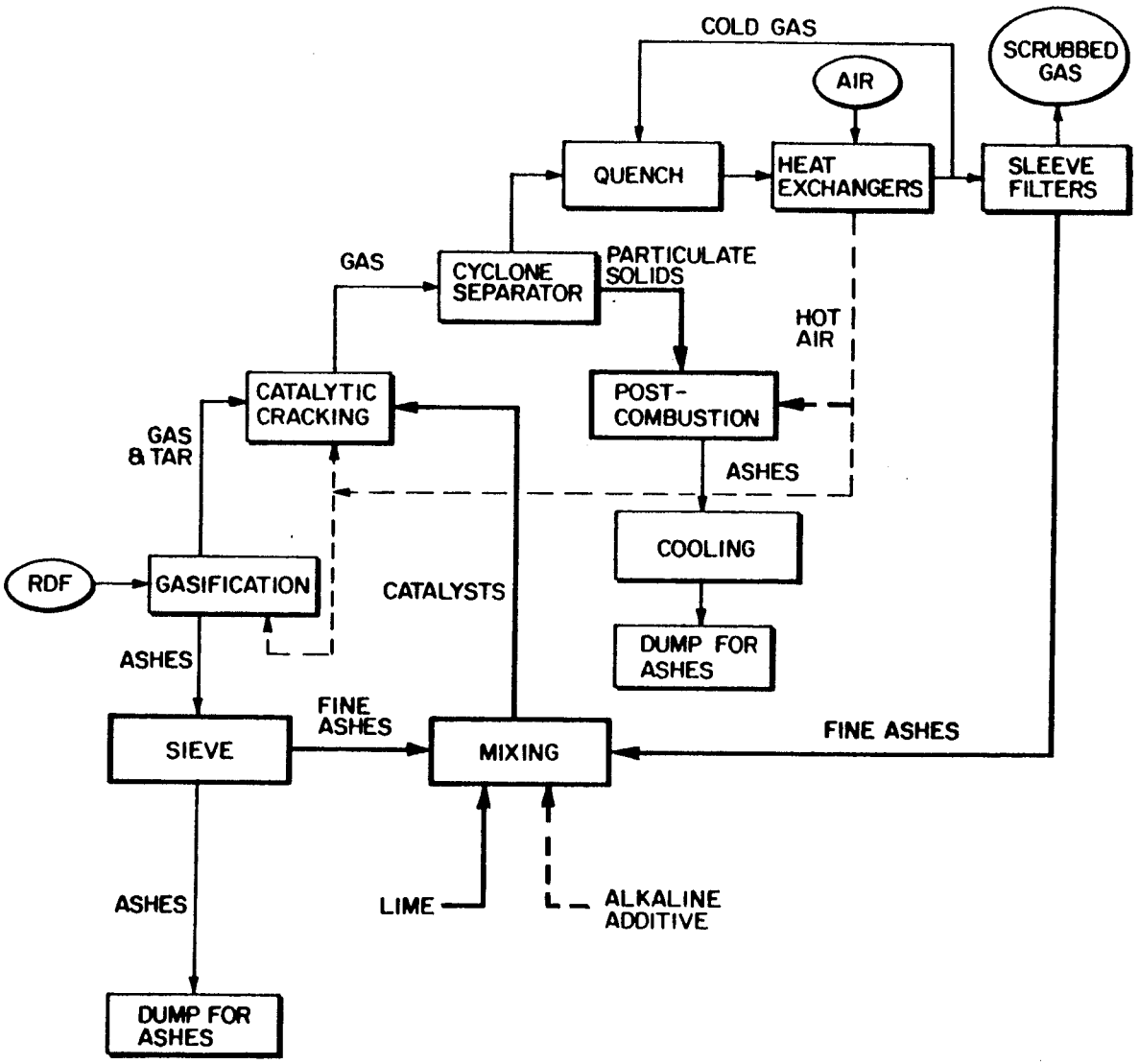
SCRUBBED GAS
SLEEVE FILTERS
COLD GAS
AIR
HEAT EXCHANGERS
QUENCH
HOT AIR
PARTICULATE SOLIDS
POST-COMBUSTION
ASHES
COOLING
DUMP FOR ASHES
FINE ASHES
CYCLONE SEPARATOR
GAS
CATALYTIC CRACKING
CATALYSTS
MIXING
ALKALINE ADDITIVE
LIME
FINE ASHES
GAS & TAR
GASIFICATION
ASHES
SIEVE
ASHES
DUMP FOR ASHES
RDF

METHOD TO CONVERT REFUSE DERIVED FUEL INTO A COMBUSTIBLE GAS

BACKGROUND OF THE INVENTION

1. Field of the Invention

This invention concerns a method to convert refuse derived fuel, whether of an urban or industrial origin, into a combustible gas, as set forth in the main claim.

The method of the invention is applied adantageously, but not only, to the processes of gasification and/or pyrolysis of conventional solid fuels or fuels derived from the screening of solid urban refuse or from the processing of biomasses.

2. Discussion of the Prior Art

The gasification technology which has been developed for some time now for the production of gas from coal or wood has been used recently with more difficult fuels, such as the residues of the processing of biomasses, solid urban refuse, and solid industrial refuse or the combustible fraction derived therefrom and conventionally called refuse derived fuel.

This technology is worthwhile since it enables the ashes to be separated from the gaseous products, which have a smaller volume than the products resulting from simple incineration, and therefore makes possible a reduction of the volumes of the equipment required to treat the gaseous products and a more efficient technique for the combustion.

Moreover, the various available technologies give birth to a gaseous mixture consisting essentially of light gases such as $CH_4$, CO, $H_2$, $H_2O$, $N_2$ and $CO_2$, but also of a moderate quantity of vapours of high-boiling hydrocarbons (tars) and of ashes containing volatile metals.

The energy content of the tars amounts to about 20% of the calorific power of the gas produced and is therefore an important fraction for the yield of heat of the process.

The chemical-physical properties of these products make problematical the employment of the gas produced in traditional usage equipment such as boilers or gas-powered engines since the gas produces harmful emissions and also deposits along the pipes and in the equipment.

It is therefore worthwhile to recover and convert these products into a usable form.

One of the most promising ways has been found to be catalytic cracking.

In the state of the art the gasification process and the successive treatment to scrub the gas thus produced comprise according to the state of the art the following steps:

the feeding of refuse derived fuel into a gasification furnace with a controlled quantity of oxidizing gas;

discharge of the residual ashes from the bottom of the furnace with a residual content of unburnt carbon, mainly in the fine fraction (fine bottom ashes). The coarse fraction (coarse bottom ash) consists mainly of sintered material, carbon free, in a glassy form suitable to undergo the leaching test limits for sanitary dumps;

extraction of the gas thus produced from the top of the gasification furnace, the gas consisting mainly of $CH_4$, CO, $H_2$, $H_2O$, $N_2$, $CO_2$ and of hydrocarbons with a wide boiling-point spectrum (tars);

catalytic cracking of the tars and ammonia by the addition of a controlled quantity of a high-temperature oxidising gas (air, for instance) and of a catalytic support (dolomite, for instance);

neutralisation of the hydrogen-halogen acids, mainly hydrochloric acid and hydrogen sulphide, contained in the gas by means of adsorption on beds of dolomite;

separation of part of the entrained particulate solid after the cracking step, in a cyclone chamber or another suitable separator;

cooling the gas by mixture with low temperature (quench) recirculated gas or by atomised water;

cooling the gas in heat exchangers with a simultaneous pre-heating of process air to be used for the gasification and catalytic cracking;

final scrubbing of the gas by filtration through bags of fabric;

combustion of the gaseous mixture containing only light fractions, such as $CH_4$, CO, $H_2$, $H_2O$, $N_2$ and $CO_2$, and therefore suitable for subsequent employment in technical usage apparatus devoid of final treatment of fumes, such as endothermic engines, boilers, heating furnaces, etc.;

the ashes separated by the bag filter are typically classified as hazardous wastes due to a high content of heavy volatile metals and toxic organic compounds (e.g. PAH=polyaromatic hydrocarbons, dioxines);

the ashes from the the gasification furnace, catalytic cracking reactor and systems to filter the gas thus produced are sent to appropriate controlled dumps.

The combustion of the gas obtained by this treament produces flu gases with a reduced corrosive action and a lower content of harmful products such as dioxin, $NO_2$ and acid products derived from the combustion of hydrogen-halogen products present in the refuse derived fuel.

The present applicant has studied, tested and brought about this invention so as to obviate the shortcomings of the state of the art and to achieve further advantages.

SUMMARY OF THE INVENTION

The invention is set forth and characterized in the main claim, while the dependent claims describe variants of the idea of the main solution.

BRIEF DESCRIPTION OF THE DRAWINGS

The attached FIGURE shows as an example a block diagram of the cyle according to the invention.

DETAILED DISCUSSION OF PREFERRED EMBODIMENTS

In the process of gasification of the refuse derived fuel according to the invention the fine fraction of the ashes gathered from the bottom of the gasification furnace and the ashes separated by the bag filter installed on the line of the gas downstream of the heat exchangers are recycled and not sent directly to the disposal dump.

The ashes from the bottom of the gasification furnace are rich in residual alkalinity and, according to the invention, are sieved and divided into a fine fraction (smaller than 2-3 mm.) and a coarse sintered fraction suitable for dumping.

The fine fraction of the ashes from the bottom of the gasification furnace and the ashes collected by the bag filter system are mixed with a suitable alkaline additive, or an equivalent product such as lime or ash, so as to generate the catalyst mixture to be sent to the cracking step.

This mixture, which acts as a catalyst for the reaction that take place during catalytic cracking, can be sent to the cracking reactor, for instance by a pneumatic conveyor.

In this way the quantity of catalyst to be fed to the cracking reactor is reduced considerably, with a resulting economical advantage for the process of treatment of the gas itself.

According to the invention a suitable quantity of lime or of an equivalent alkaline product to abate the chlorine content is introduced into the cycle together with the ashes.

According to the invention the ashes and the lime are introduced into the cycle in the gas line upstream of the catalytic cracking reactor so as to accomplish a reduction of unburnt material and a partial recovery of energy.

In this way, besides the economical advantage of a greater yield of the gasification process, there is also an environmental advantage resulting from the reduction inertization of the solid effluent to be sent for dumping.

Moreover, during the gasification process according to the invention the gas leaving the catalytic cracking reactor undergoes a step of separation, by means of a cyclone separator for instance, before being cooled.

The particulate solid thus separated undergoes a postcombustion treatment with preheated air at a high temperature.

The heat generated by this postcombustion is used directly to complete the catalytic cracking reactions.

The mass of recirculated ashes consists, for the most part, of solid carbon coke, which in the established cracking conditions is converted efficiently, by means of reaction with the water vapour present, into oxides of carbon and hydrogen, thus increasing the yield of combustible gases.

Moreover, in the method according to the invention the recirculated ashes contribute towards keeping the cracking conditions stable and and improving the heat recovery during the subsequent treatment steps.

The quantity of recirculated ashes can be regulated suitably, and also automatically, so as to keep the operational cracking conditions stable and thus to lessen the problems due to fluctuations, even sudden fluctuations, in the characteristics of the gas produced in the previous gasification step.

The operational conditions of the postcombustion enable residual ashes to be obtained with a minimum content of unburnt material and with an efficient thermal destruction of harmful organic carbonous products.

This postcombustion of unburnt ashes takes place advantageously, but not necessarily, in an appropriate chamber located below the discharge of the cyclone separator.

In this way the residual solids of the postcombustion step consist of inert materials and represent the only solid effluent of the treatment cycle together with the coarse ashes from the bottom of the gasification furnace.

The quantity of this solid effluent of the cycle amounts to about 8% to 10% by weight of the burnt refuse derived fuel.

In this way, besides the reduction of the unburnt material, there is also a partial recovery of energy, which increases the yield of the gasification process and makes the process still more worthwhile financially.

I claim:

1. Method to convert refuse derived fuel (RDF) into a combustible gas, comprising the following steps:

gasifying the refuse derived fuel in a gasification furnace forming derived gas and ashes of gasification;

separating said derived gas and ashes of gasification;

catalytically cracking the derived gas in which at least one alkaline additive is used;

passing the gas from said catalytically cracking step through a cyclone separator to collect particulate solids;

cooling said gas from said separator with a recovery of hot air;

passing said cooled gas through bag filters;

transferring a portion of ashes of gasification and the separated particulate solids to a dump for ashes;

sieving said ashes of gasification to gather the fines; and mixing fines from said ashes of gasification with fines recovered from the bag filters and adding said mixture to said derived gas as catalysts in the catalytically cracking step.

2. Method as claimed in claim 1, in which the alkaline additive is added during the step of mixing the fines.

3. Method as claimed in claim 1, in which lime product is added during the step of mixing the fines.

4. Method as claimed in claim 1, in which the particulate solids leaving the cyclone separator undergo a postcombustion step.

5. Method as claimed in claim 1, wherein hot air recovered by said cooling step is employed in a further step of postcombustion of the particulate solids leaving the cyclone separator.

6. Method as claimed in claim 5, in which said postcombustion step produces heat used directly to complete the catalytic cracking reactions.

7. Method as claimed in claim 1, in which said recirculated fines consists of activated carbon, and said cracking step includes converting said carbon, by reaction with water vapour, into oxides of carbon and hydrogen, thereby increasing the yield of the combustible gases.

8. Method as claimed in claim 1, wherein said fines added to said derived gas comprise a step of keeping the cracking conditions stable and homogeneous and increasing heat exchange of subsequent treatment steps.

9. Method as claimed in claim 1, wherein there is further included the step of automatically regulating the fines added to said derived gas.

10. Method as claimed in claim 5, wherein said postcombustion step includes the step of reducing content of unburnt material and thermal destruction of harmful organic carbonous products.

* * * * *